US007555814B2

(12) United States Patent
Lee et al.

(10) Patent No.: US 7,555,814 B2
(45) Date of Patent: Jul. 7, 2009

(54) CLEANER HAVING CLOTH HOLDER

(75) Inventors: Jeong Ho Lee, Goyang-si (KR); Jay Ho Choi, Seoul (KR); Hyoung Jun Kim, Seoul (KR); Sung Il Park, Anyang-si (KR)

(73) Assignee: LG Electronics Inc., Seoul (KR)

( * ) Notice: Subject to any disclaimer, the term of this patent is extended or adjusted under 35 U.S.C. 154(b) by 212 days.

(21) Appl. No.: 11/561,566

(22) Filed: Nov. 20, 2006

(65) Prior Publication Data

US 2007/0136974 A1 Jun. 21, 2007

(30) Foreign Application Priority Data

Nov. 25, 2005 (KR) ..... 10-2005-0113460

(51) Int. Cl.
*A47L 13/10* (2006.01)

(52) U.S. Cl. ..... 15/403; 15/49.1; 15/97.1; 15/118; 15/209.1; 15/228; 15/230.19; 15/231

(58) Field of Classification Search ..... 15/393, 15/401, 403, 49.1, 97.1, 98, 118, 146, 147.1, 15/209.1, 228, 230.19, 231; *A47L 13/10; B05C 1/06*
See application file for complete search history.

(56) References Cited

U.S. PATENT DOCUMENTS

| | | | | |
|---|---|---|---|---|
| 1,603,175 | A | 10/1926 | Weisz | |
| 2,634,444 | A * | 4/1953 | Coleman | 15/220.2 |
| 4,658,461 | A * | 4/1987 | Roe et al. | 15/210.1 |
| 4,811,446 | A | 3/1989 | Tsukamoto | |
| 5,991,961 | A * | 11/1999 | Zurik | 15/210.1 |
| 2004/0194245 | A1 * | 10/2004 | Lee | 15/229.4 |
| 2006/0016030 | A1 | 1/2006 | Rothweil et al. | |
| 2006/0260083 | A1 * | 11/2006 | Rothweil et al. | 15/231 |
| 2007/0006413 | A1 | 1/2007 | Lee | |
| 2007/0124891 | A1 | 6/2007 | Lee et al. | |

FOREIGN PATENT DOCUMENTS

| | | |
|---|---|---|
| BE | 1009772 | 8/1997 |
| DE | 19940436 | 3/2001 |
| DE | 20114744 | 11/2001 |
| EP | 1795107 | 6/2007 |
| FR | 2367474 | 5/1978 |
| FR | 2655250 | 6/1991 |

(Continued)

OTHER PUBLICATIONS

English language Abstract of DE 19940436.

(Continued)

*Primary Examiner*—David A Redding
(74) *Attorney, Agent, or Firm*—McKenna Long & Aldridge

(57) ABSTRACT

A cleaner is disclosed, by which a floorcloth is attached to a correct position on a bottom of the cleaner, and by which a floorcloth can be attached to a correct position without turning a cleaner body upside down, thereby preventing a hazardous condition. The present invention includes a body configured as a cleaner head, an electric magnet provided adjacent to one side of a bottom of the body to generate a magnetic field during application of an electrical signal, and a floorcloth having a conductive body provided at a position opposing the electric magnet.

20 Claims, 5 Drawing Sheets

FOREIGN PATENT DOCUMENTS

| | | |
|---|---|---|
| KR | 10-0439952 | 7/2004 |
| KR | 10-2004-0091886 | 11/2004 |
| SU | 1155241 | 5/1985 |
| WO | 2004/086931 | 10/2004 |

OTHER PUBLICATIONS

English language Abstract of KR 10-2004-0091886.
U.S. Appl. No. 11/608,555 to Chung et al., filed Dec. 8, 2006.
U.S. Appl. No. 11/566,943 to Chung et al., filed Dec. 5, 2006.
English language Abstract of FR 19940436, May 12, 1978.
English language Abstract of BE 1009772, Aug. 5, 1997.
English language Abstract of KR 1020030054622, Jul. 2, 2003.
English language Abstract of SU 1155241, May 15, 1985.

* cited by examiner

CLEANER HAVING CLOTH HOLDER

This application claims the benefit of Korean Patent Application No. P2005-0113460, filed on Nov. 25, 2005, which is hereby incorporated by reference in its entirety.

BACKGROUND OF THE INVENTION

1. Field of the Invention

The present invention relates to a cleaner, and more particularly, to a steam cleaner. Although the present invention is suitable for a wide range of applications, it is particularly suitable for attaching a floorcloth to a bottom of the cleaner.

2. Discussion of the Related Art

Generally, a steam cleaner mops a floor using a floorcloth attached to a bottom of a cleaner body.

FIG. 1 is a perspective diagram of a steam cleaner according to a related art.

Referring to FIG. 1, a steam cleaner according to a related art consists of a cleaner body 3 and a floorcloth 7 attached to a bottom of the cleaner body 3 using Velcro 5 provided on the floorcloth 7.

In case of fixing the floorcloth to the related art steam cleaner using Velcro, the floorcloth is preferentially placed on a floor. The cleaner body is then pressed onto the floorcloth.

However, if a user fails to press the cleaner body onto the floorcloth downwardly in a vertical direction, the floorcloth may be incorrectly or inadequately attached to the cleaner body.

In case of fixing a floorcloth to a related art steam cleaner using a rubber ring, a steam cleaner body must be turned upside down.

However, in case of turning the steam cleaner upside down to attach the floorcloth, water may be spilt from the steam cleaner, creating a hazardous condition for potential accidents.

SUMMARY OF THE INVENTION

Accordingly, the present invention is directed to a cleaner that substantially obviates one or more problems due to limitations and disadvantages of the related art.

An object of the present invention is to provide a cleaner, by which a floorcloth is easily attached to a correct position of a bottom of the cleaner.

Another object of the present invention is to provide a cleaner, by which a floorcloth can be attached to a correct position without turning a cleaner body upside down, in order to prevent accidents.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cleaner according to the present invention includes a body configured as a cleaner head, an electric magnet provided adjacent to one side of a bottom of the body to generate a magnetic field during application of an electrical signal, and a floorcloth having a conductive body provided at a position opposing the electric magnet.

Preferably, the electric magnet is provided at a bottom surface of an insertion recess recessed into the bottom of the body.

More preferably, the cleaner further includes a guide hole provided in a side of the insertion recess and a fixing holder passing through the guide hole to fix the floorcloth to the bottom of the body by sliding along the bottom of the body to hold the conductive body.

More preferably, the fixing holder includes a slider passing through the guide hole to slide along the bottom of the body and a clamping member provided on a front end of the slider to fix the floorcloth to the body by holding the conductive body.

More preferably, the clamping member includes a pressurizing plate for pressing the conductive body.

More preferably, a guide recess is provided in an edge of the guide hole and a holding lug is projected from an outer circumference of the slider to match the guide recess.

More preferably, a loading recess is provided in a side of the insertion recess opposed to the side provided with the guide hole, such that the conductive body is pushed by the pressurizing plate into the loading recess.

More preferably, an elastic member is provided in the loading recess to enable the conductive body to be discharged into the insertion recess.

More preferably, the elastic member includes a return spring.

Preferably, the electric magnet extends in a length direction of the bottom of the body and wherein the conductive body is configured to have a bar shape corresponding to the electric magnet.

Preferably, a pair of the electric magnets are provided adjacent to opposite sides of the bottom of the body and a pair of the conductive bodies are provided on opposite ends of the floorcloth corresponding to the pair of the electric magnets, respectively.

More preferably, the conductive body and the floorcloth are configured to be mutually detachable.

A cleaner head according to the present invention includes an electric magnet provided adjacent to one side of a bottom of the cleaner head to generate a magnetic field during application of an electrical signal, and a floorcloth having a conductive body provided at a position opposing the electric magnet.

Preferably, the electric magnet is provided at a bottom surface of an insertion recess recessed into the bottom of the cleaner head.

Preferably, the cleaner head further includes a guide hole provided in a side of the insertion recess, and a fixing holder passing through the guide hole to fix the floorcloth to the bottom of the cleaner head by sliding along the bottom of the cleaner head to hold the conductive body.

Preferably, the fixing holder includes a slider passing through the guide hole to slide along the bottom of the cleaner head, and a clamping member provided on a front end of the slider to fix the floorcloth to the cleaner head by holding the conductive body.

Preferably, the clamping member includes a pressurizing plate for pressing the conductive body.

Preferably, a guide recess is provided in an edge of the guide hole and wherein a holding lug is projected from an outer circumference of the slider to match the guide recess.

Preferably, a loading recess is provided in a side of the insertion recess opposed to the side provided with the guide hole, such that the conductive body is pushed by the pressurizing plate into the loading recess.

Preferably, an elastic member is provided in the loading recess to enable the conductive body to be discharged into the insertion recess.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
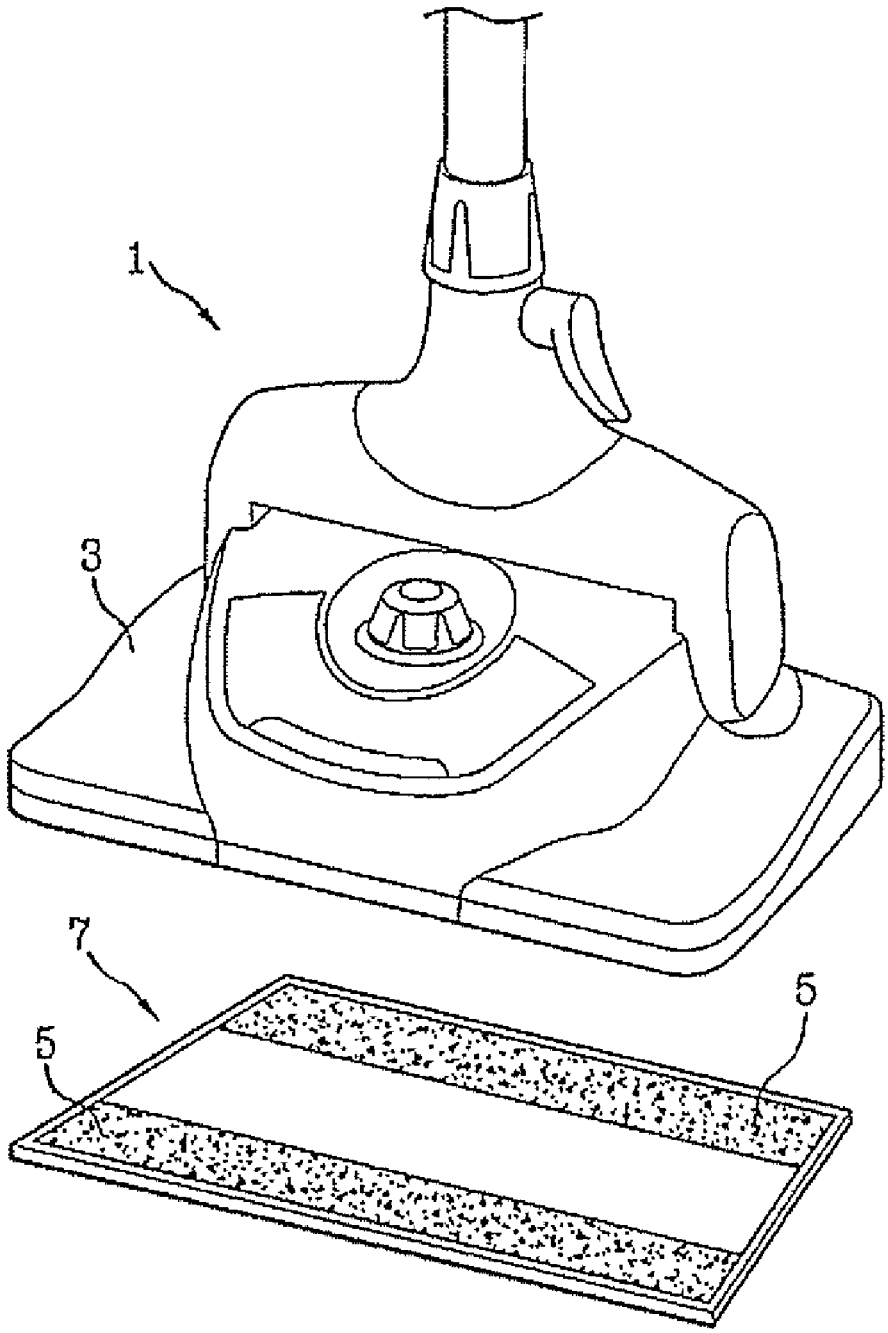
FIG. 1 RELATED ART
FIG. 1 is a perspective view of a steam cleaner according to a related art.
Figure 2:
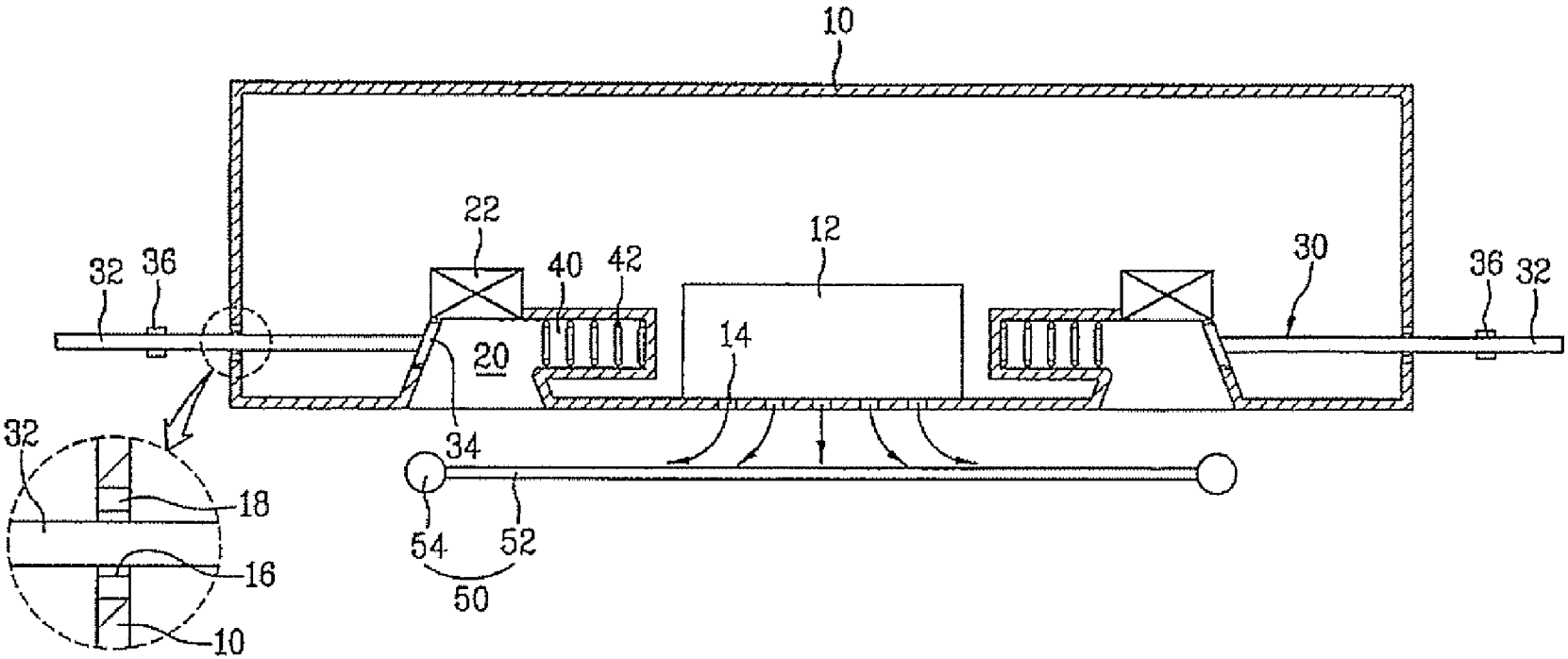
FIG. 2 is a cross-sectional view of a steam cleaner according to a preferred embodiment of the present invention.
Figure 3:
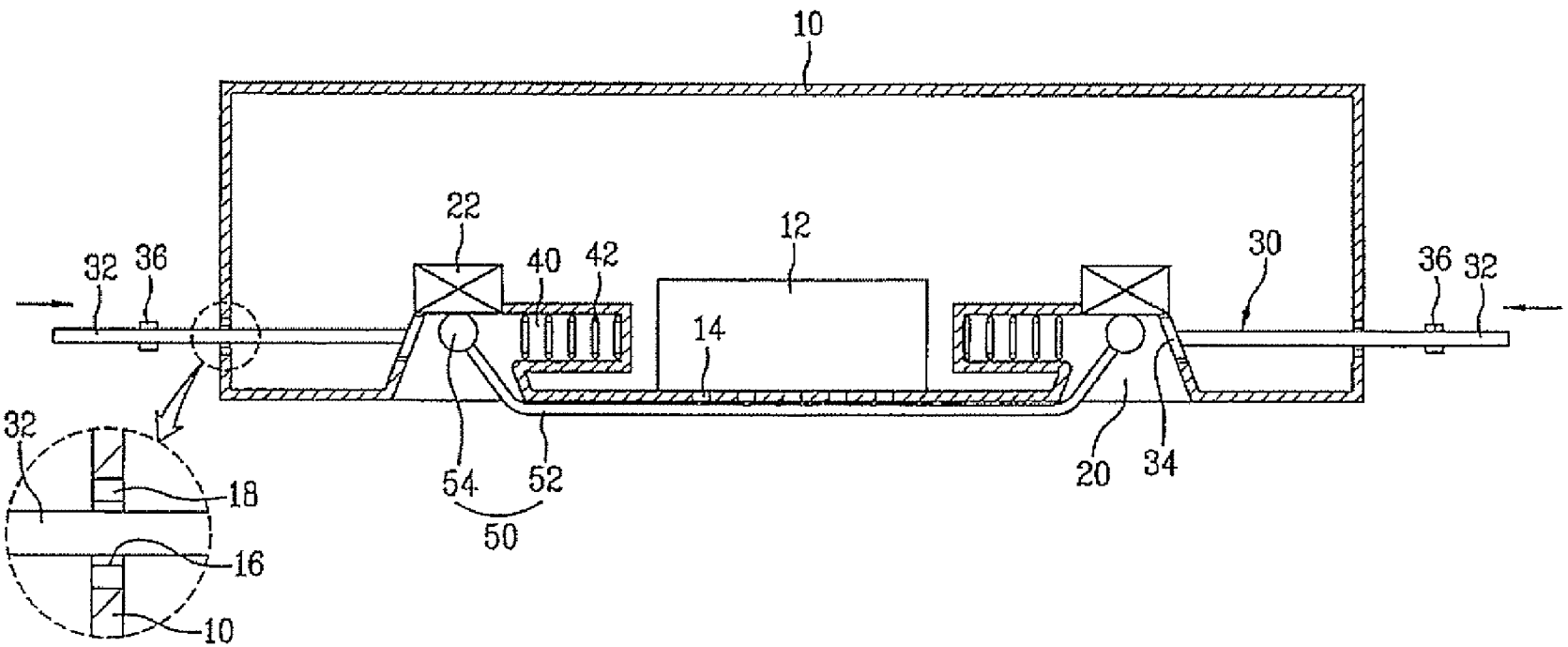
FIG. 3 is a cross-sectional view of the steam cleaner shown in FIG. 2 depicting contact between a conductive substance of a floorcloth and an electric magnet.
Figure 4:
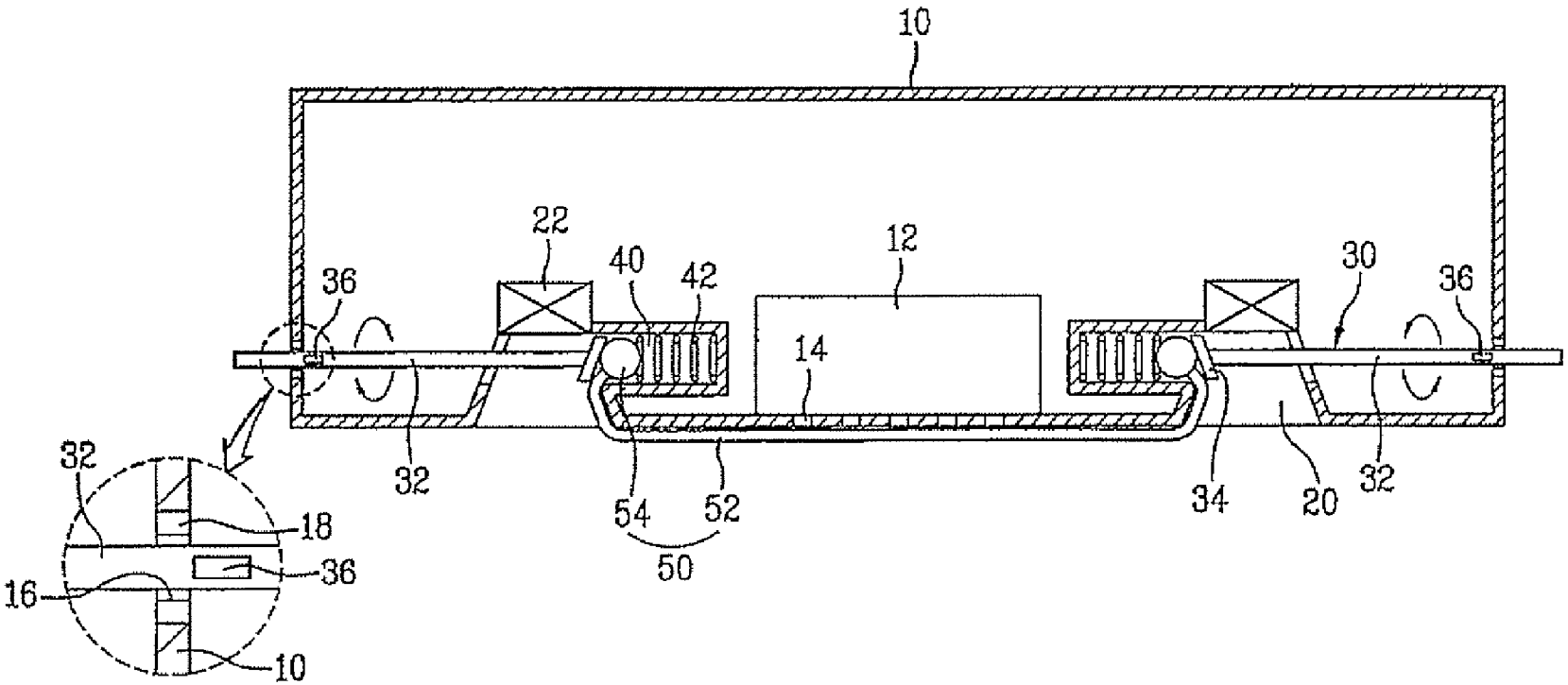
FIG. 4 is a cross-sectional view of the steam cleaner shown in FIG. 2 depicting attachment of a floorcloth.
Figure 5:
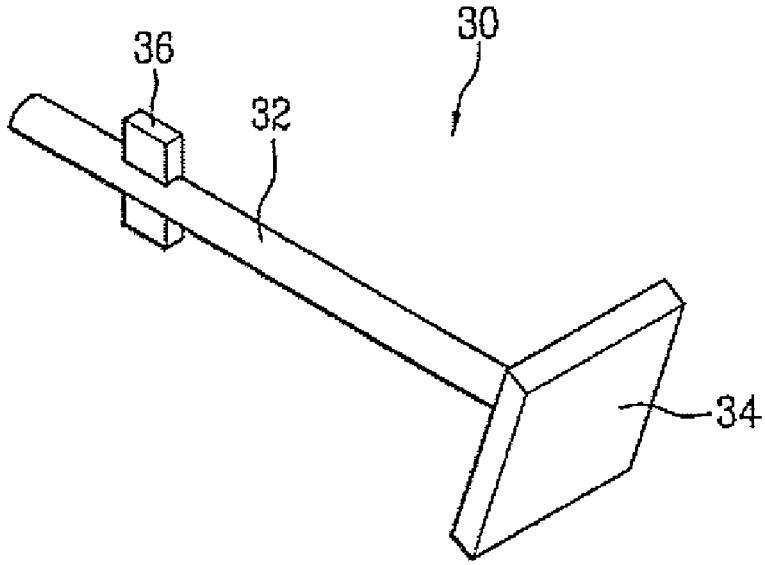
FIG. 5 is a perspective view of a fixing holder of the steam cleaner shown in FIG. 2.
Figure 6:
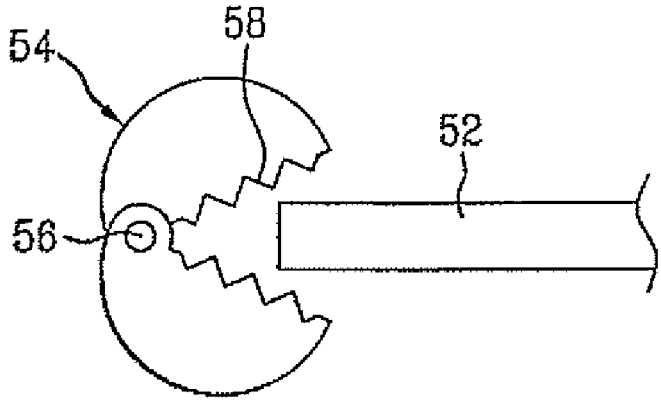
FIG. 6 is a perspective view of a conductive body of the steam cleaner shown in FIG. 2.

FIG. 2 is a cross-sectional view of a steam cleaner according to a preferred embodiment of the present invention, FIG. 3 is a cross-sectional view of the steam cleaner shown in FIG. 2 depicting contact between a conductive substance of a floorcloth and an electric magnet, FIG. 4 is a cross-sectional view of the steam cleaner shown in FIG. 2 depicting attachment of a floorcloth of the cleaner shown in FIG. 2, FIG. 5 is a perspective view of a fixing holder of the steam cleaner shown in FIG. 2, and FIG. 6 is a perspective view of a conductive body of the steam cleaner shown in FIG. 2.

Referring to FIGS. 2 to 5, a cleaner according to the present invention includes a body 10 configured as a cleaner head and a steam generator 12 provided within the body 10.

In particular, the steam generator 12 has an outlet 14 installed to face a bottom of the body 10, thereby enabling steam to pass therethrough toward a floor to be cleaned.

An insertion recess 20 is provided adjacent to one side of the bottom of the cleaner body 10. A conductive body 54 of a floorcloth 50 is configured to be fitted into the insertion recess 20. Further, as shown in the Figures, insertion recesses may be provided adjacent to opposite sides of the bottom of the cleaner body 10.

An electric magnet 22 is provided on a bottom of the insertion recess 20. The electric magnet 22 generates a magnetic field to induce an attractive force with the conductive body 54.

A fixing holder 30 is provided to one side of an edge of the insertion recess 20 to fix the conductive body 54 therein. The fixing holder 30 pushes the conductive body 54 in a prescribed direction to be fitted into a loading recess 40 that will be explained in the following description.

The fixing holder 30, as shown in FIG. 2, is installed to slide along a bottom surface of the insertion recess 20 of the cleaner body 10. The fixing holder 30 includes a slider 32 sliding along a guide hole 16 provided in the cleaner body 10 and a clamping member 34 provided to a front end of the slider 32 to hold the conductive body 54 to be fixed thereto. Preferably, the clamping member 34 includes a pressurizing plate that presses the conductive body 54.

A holding lug 36 is provided on an outer circumference of the slider 32 adjacent one end thereof. The holding lug 36 is able to move inside/outside the body 10 along a guide recess 18 provided to an edge of the guide hole 16.

The holding lug 36 is guided into the body 10 along the guide recess 18 of the body 10. The slider 32 is then rotated to hold the holding lug 36 by the edge of the guide hole 16. Thus, the holding lug 36 fixes or locks the slider 32 so as not to be withdrawn.

The loading recess 40 is provided on one side of the insertion recess 20 so as to be recessed in a slide progression direction of the fixing holder 30. The conductive body 54 of the floorcloth 50 is pushed by the fixing holder 30 into the loading recess 40.

An elastic member 42 is provided within the loading recess 40. The elastic member 42 facilitates discharge of the conductive body 54 from the loading recess 40 when the fixing holder 30 is released. The elastic member 42 may be of any suitable form, such as a return spring.

The floorcloth 50 is attached to a bottom of the body 10. The floorcloth 50 includes a cloth portion 52 which may be formed of any suitable material, such as wool, to wipe out particles or filth. The conductive body 54 may be formed of any suitable material, such as a metal based material, and may be provided to both ends of the cloth part 52.

The conductive body 54 is positioned so as to oppose the insertion recess 20. Preferably, the conductive body 54 is positioned so as to oppose the electric magnet 22. The conductive body 54 adheres closely to the electric magnet 22 by the magnetic field generated from the electric magnet 22 when an electrical signal is applied. Thus, the floorcloth 50 is able to be fixed to the bottom of the body 10.

Preferably, the conductive body 54 and the cloth part 52 are configured to be detachable from each other.

Referring to FIG. 6, the conductive body 54 is divided into an upper part and a lower part. The upper and lower parts are coupled to each other by a hinge 56 so as to be opened/closed. In assembling the floorcloth 50, the cloth part 52 is inserted in the open conductive body 54. The conductive body 54 is then closed to fix the cloth part 52 to the conductive body 54. If the cloth part 52 needs to be detached for washing or the like, the conductive body 54 is opened to separate the cloth part 52 from the conductive body 54.

To increase a fixing power of the cloth part 52 to the conductive body 54, a multitude of projections or teeth 58 are provided to portions of the conductive body 54 for fixing the cloth part 52 thereto. Optionally, a fixing device (not shown in the drawing) can be further provided to enable the conductive body 54 to maintain its closed state by selectively inhibiting the opened state of the conductive body 54.

Operations of the above-configured cleaner according to the present invention are explained in detail as follows.

First of all, a process for attaching the floorcloth 50 to the cleaner body 10 is explained.

In particular, a user places the floorcloth 50 under the cleaner body 10.

Once the floorcloth 50 is located under the body 10, the user activates the cleaner body 10 to apply an electrical signal to the electric magnet 22. In this case, even if the floorcloth 50, and more particularly, the conductive body 54 is not correctly positioned under the electric magnet 22, the conductive body 54 can be easily guided to the insertion recess 20 by the magnetic force of the electric magnet 22.

After the conductive body 54 has been inserted in the insertion recess 20, the user makes the fixing holder 30 slide in a direction of the loading recess 40 to have the holding lug 36 pass through the guide recess 18 of the guide hole 16. Once the holding lug 36 passes through the guide recess 18, the slider 32 is rotated clockwise or counterclockwise.

As the slider 32 is rotated, the holding lug 36 is disengaged from the guide recess 18 to be held by the edge of the guide hole 16. So, the fixing holder 30, as shown in FIG. 4, is able to maintain pressure on the conductive body 54.

A process for separating the floorcloth 50 from the cleaner body 10 is explained as follows.

The slider 32 of the fixing holder 30 is rotated to align the holding recess 36 with the guide recess 18.

Once the holding lug 36 is aligned with the guide recess 18, the elastic recovery of the elastic member 42 pushes the fixing holder 30 from the loading recess 40 outwardly. As the fixing holder 30 is pushed away, the conductive body 54 of the floorcloth 50 is pushed outwardly as well.

In this case, since no electrical signal is applied to the electric magnet 22, the conductive body 54 is discharged downwardly along the insertion recess 20. So, the floorcloth 50 is able to be completely separated from the body 10.

In case that the cloth part 52 needs to be washed due to dirt or contamination, the conductive body 54 is opened to disengage the cloth part 52 from the conductive body 54. The cloth part 52 is then washed or replaced by a new one, so that a clean cloth part 52 is combined with the conductive body 54.

Hence, the floorcloth 50 can be easily washed. Further, the floorcloth 50 provided with a cleaner when purchase can be replaced by a home-used cloth or the like.

It will be understood by those skilled in the art that various modifications can be made to the embodiments of the present invention. For instance, the insertion recess 20 can be configured to extend in a length direction along the bottom of the body 10. The electric magnet 22 may also extend in the insertion recess 20 in the length direction. Further, the conductive body 54 may be configured to have a bar shape in the length direction corresponding to the electric magnet 22.

Accordingly, the present invention provides at least the following effects or advantages.

First of all, since a floorcloth of a steam cleaner is attached using an electric magnet, a user's convenience is enhanced by facilitating loading of the floorcloth in a correct position.

Secondly, it is unnecessary for a user to check a bottom surface of a cleaner during attachment of a floorcloth to the cleaner. Thus, the present invention is able to prevent hazardous conditions or accidents due to hot water spilled from the cleaner or the like.

Finally, the enhanced convenience of floorcloth loading and the accident prevention increase customer's desire for purchasing the cleaner.

It will be apparent to those skilled in the art that various modifications and variations can be made in the present invention without departing from the spirit or scope of the inventions. Thus, it is intended that the present invention covers such modifications and variations of the invention.

What is claimed is:

1. A cleaner comprising:

a body configured as a cleaner head;

an electric magnet provided adjacent to one side of a bottom of the body to generate a magnetic field during application of an electrical signal;

a floorcloth having a conductive body provided at a position opposing the electric magnet; and an insertion recess recessed into the bottom of the body, the insertion recess being configured to receive the conductive body of the floorcloth therein.

2. The cleaner of claim 1, wherein the electric magnet is provided at a bottom surface of the insertion recess.

3. The cleaner of claim 1, further comprising:

a guide hole provided in a side of the insertion recess; and a fixing holder passing through the guide hole to fix the floorcloth to the bottom of the body by sliding along the bottom of the body to hold the conductive body.

4. The cleaner of claim 3, the fixing holder comprising:

a slider passing through the guide hole to slide along the bottom of the body; and a clamping member provided on a front end of the slider to fix the floorcloth to the body by holding the conductive body.

5. The cleaner of claim 4, the clamping member comprising a pressurizing plate for pressing the conductive body.

6. The cleaner of claim 5, wherein a guide recess is provided in an edge of the guide hole and wherein a holding lug is projected from an outer circumference of the slider to match the guide recess.

7. The cleaner of claim 6, wherein a loading recess is provided in a side of the insertion recess opposed to the side provided with the guide hole, such that the conductive body is pushed by the pressurizing plate into the loading recess.

8. The cleaner of claim 7, wherein an elastic member is provided in the loading recess to enable the conductive body to be discharged into the insertion recess.

9. The cleaner of claim 8, wherein the elastic member comprises a return spring.

10. The cleaner of claim 1, wherein the electric magnet extends in a length direction of the bottom of the body and wherein the conductive body is configured to have a bar shape corresponding to the electric magnet.

11. The cleaner of claim 1, wherein a pair of the electric magnets are provided adjacent to opposite sides of the bottom of the body and wherein a pair of the conductive bodies are provided on opposite ends of the floorcloth corresponding to the pair of the electric magnets, respectively.

12. The cleaner of claim 11, wherein the conductive body and the floorcloth are configured to be mutually detachable.

13. A cleaner head comprising:

an electric magnet provided adjacent to one side of a bottom of the cleaner head to generate a magnetic field during application of an electrical signal;

a floorcloth having a conductive body provided at a position opposing the electric magnet; and an insertion recess recessed into the bottom of the cleaner head, the insertion recess being configured to receive the conductive body of the floorcloth therein.

14. The cleaner head of claim 13, wherein the electric magnet is provided at a bottom surface of the insertion recess.

15. The cleaner head of claim 13, further comprising:

a guide hole provided in a side of the insertion recess; and a fixing holder passing through the guide hole to fix the floorcloth to the bottom of the cleaner head by sliding along the bottom of the cleaner head to hold the conductive body.

16. The cleaner head of claim 15, the fixing holder comprising:

a slider passing through the guide hole to slide along the bottom of the cleaner head; and a clamping member provided on a front end of the slider to fix the floorcloth to the cleaner head by holding the conductive body;

17. The cleaner head of claim 16, the clamping member comprising a pressurizing plate for pressing the conductive body.

18. The cleaner head of claim 17, wherein a guide recess is provided in an edge of the guide hole and wherein a holding lug is projected from an outer circumference of the slider to match the guide recess.

19. The cleaner head of claim 18, wherein a loading recess is provided in a side of the insertion recess opposed to the side provided with the guide hole, such that the conductive body is pushed by the pressurizing plate into the loading recess.

20. The cleaner head of claim 19, wherein an elastic member is provided in the loading recess to enable the conductive body to be discharged into the insertion recess.

* * * * *